US006576878B2

(12) United States Patent
Thorpe et al.

(10) Patent No.: US 6,576,878 B2
(45) Date of Patent: Jun. 10, 2003

(54) TRANSVERSE FLUX INDUCTION HEATING APPARATUS

(75) Inventors: John C. Thorpe, Edgewater Park, NJ (US); Hans G. Heine, San Mateo, FL (US); Vitaly A. Peysakhovich, Moorestown, NJ (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 10/026,214

(22) Filed: Dec. 19, 2001

(65) Prior Publication Data

US 2002/0121512 A1 Sep. 5, 2002

Related U.S. Application Data

(60) Provisional application No. 60/259,578, filed on Jan. 3, 2001.

(51) Int. Cl.[7] ..... H05B 6/40; H05B 6/06

(52) U.S. Cl. ..... 219/645; 219/670; 219/667; 219/672; 219/673

(58) Field of Search ..... 219/645, 646, 219/635, 656, 662, 667, 670, 672, 673, 675, 676, 677; 266/129

(56) References Cited

U.S. PATENT DOCUMENTS

| | | | | |
|---|---|---|---|---|
| 1,981,631 A | * | 11/1934 | Northrup | 219/662 |
| 4,258,241 A | * | 3/1981 | Soworowski et al. | 219/656 |
| 4,678,883 A | * | 7/1987 | Saitoh et al. | 219/645 |
| 5,025,122 A | * | 6/1991 | Howell | 219/662 |

* cited by examiner

*Primary Examiner*—Philip H. Leung
(74) *Attorney, Agent, or Firm*—Philip O. Post

(57) ABSTRACT

A transverse flux induction heating apparatus adjusts the level of edge heating of a workpiece by changing the pole pitch of induction coils forming the apparatus to provide a more uniform transverse temperature of the workpiece. Changes in the operating frequency of the induction power supply and in the distance between induction coils and workpiece are not required to adjust edge frequency heating. The pole pitch, and therefore, the level of edge heating can be continuously changed, or conveniently adjusted prior to a production run, in a high speed continuous heat treatment process for a workpiece.

9 Claims, 4 Drawing Sheets

TRANSVERSE FLUX INDUCTION HEATING APPARATUS

CROSS REFERENCE TO RELATED APPLICATIONS

This application claims the benefit of U.S. Provisional Application No. 60/259,578, filed Jan. 3, 2001.

BACKGROUND OF THE INVENTION

1. Field of the Invention

The present invention generally relates to transverse flux induction heating and more particularly to transverse flux induction heating with induction coil turns having an adjustable coil pitch.

2. Description of Related Art

A conventional transverse flux induction apparatus 100 is shown in exploded view in FIG. 1. The apparatus includes a coil pair comprising a first and second coil, 112 and 114, respectively, configured as two-turn coils. Transverse (substantially perpendicular to the longitudinal direction of workpiece 120, as indicated by the arrow labeled "X") segments and longitudinal (approximately parallel with the longitudinal direction of workpiece 120) segments of each coil form a generally rigid and continuous coil. The pole pitch, $\tau$, is fixed for each turn of the two-turn first and second coil segments. A magnetic flux concentrator 116, shown as laminated steel plates, surrounds the first and second coils generally in all directions except for coil surfaces that face workpiece 120, which is a continuous metal workpiece (such as a metal strip) that will be inductively heated as it passes between the coil pair. For clarity of coil arrangements in FIG. 1, the concentrator for coil 112 is shown in broken view and the concentrator for coil 114 is not shown. In this exploded view, coil gap, $g_c$, is exaggerated. In typical applications, the coil gap is generally only larger than the thickness, $d_s$, of the workpiece as to allow unobstructed travel of the strip between the coils. When in-phase ac electric power is applied to the terminals of the first and second coil sections (that is, for example, instantaneously positive power to terminals 1 and 3, and instantaneously negative power to terminals 2 and 4), the current flowing through the first and second coils establish a common magnetic flux that passes perpendicularly through the workpiece as illustrated by the exemplary dashed flux line in FIG. 1, with the arrows indicating the direction of the flux.

FIG. 2 is a graph plotting the temperature across the transverse of a workpiece. Transverse points on the workpiece (x-axis) are normalized with 0.0 representing the center of the transverse and +1 and −1 representing the opposing edges of the transverse. Curve 81 in FIG. 2 is a plot of the typical cross sectional temperature distribution for a workpiece that is inductively heated by the common magnetic flux established in a conventional transverse flux coil pair. If the workpiece enters the transverse flux induction apparatus 100 with its edges at temperatures lower than the temperature at the center of the workpiece, this effect could be used to an advantage to more evenly heat the workpiece across its width or transverse. However, if the workpiece enters the apparatus with a uniform temperature across its transverse, the edges will be overheated. For this condition, it would be ideal to inductively heat the workpiece uniformly across its transverse, as indicated by line 82 in FIG. 2. The frequency of the power source can be varied to some extent to compensate for the edge overheating effect, at the expense of a significant increase in the cost of the power supply. Alternatively, discrete edge heaters, in addition to a main induction heating apparatus, can be used to compensate for this non-uniform cross sectional heating. See, for example, U.S. Pat. No. 5,156,683 entitled *Apparatus for Magnetic Induction Edge Heaters with Frequency Modulation*. However, this approach requires additional equipment and a more complex control system.

Therefore, there exists the need for a transverse flux induction heating apparatus and method that will provide a quick and efficient method of reconfiguring the coil pair to provide a variable degree of heating across the cross section of a workpiece, including selective edge heating, without changing the frequency of the induction power source or adding separate edge heaters.

BRIEF SUMMARY OF THE INVENTION

In one aspect the present invention is a transverse flux induction heating apparatus and method that allows continuous adjustment of the operating pole pitch for a coil pair used in the apparatus to heat the transverse of the workpiece to a substantially uniform temperature. These and other aspects of the invention are set forth in the specification and claims.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 5(*b*) is a cross sectional view of one example of a transverse flux induction heating apparatus of FIG. 5(*a*) as indicated by section line A—A in FIG. 5(*a*).

DETAILED DESCRIPTION

Figure 3:
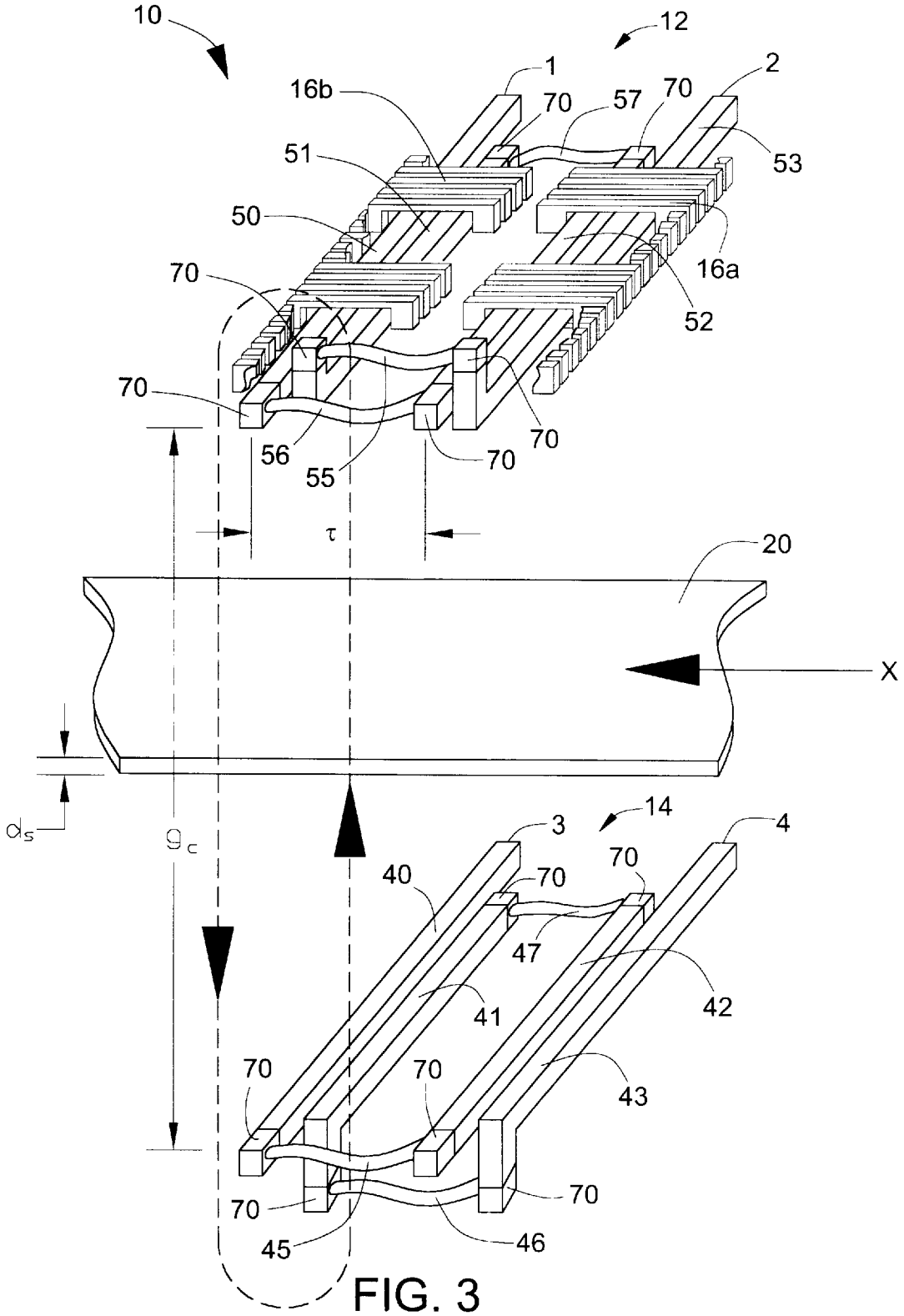
FIG. 3 is an exploded perspective view of one example of a transverse flux induction heating apparatus of the present invention with its pole pitch adjusting apparatus removed.
Figure 5B:
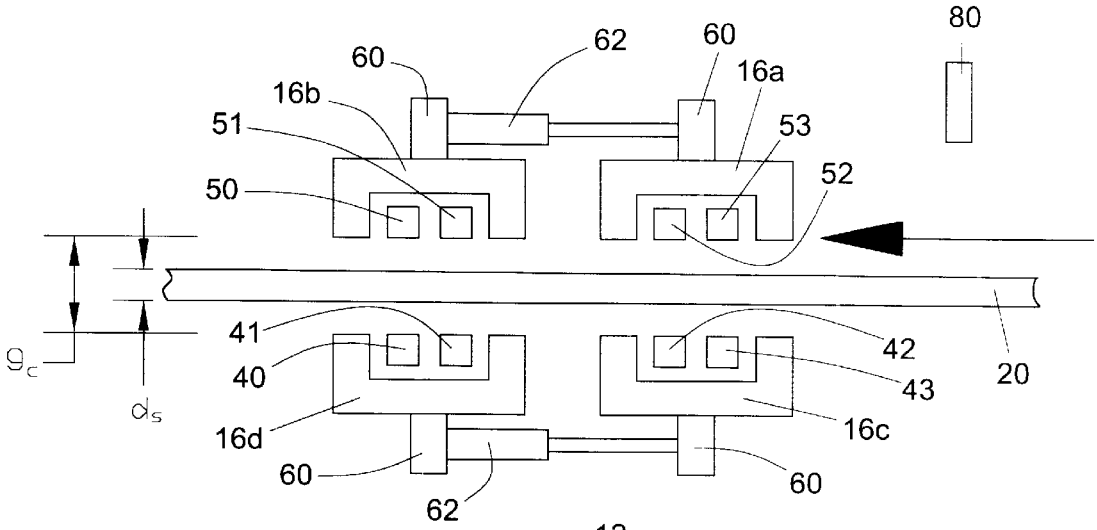
FIG. 5(*a*) is a top view of one example of a transverse flux induction heating apparatus of the present invention.
Figure 5A:
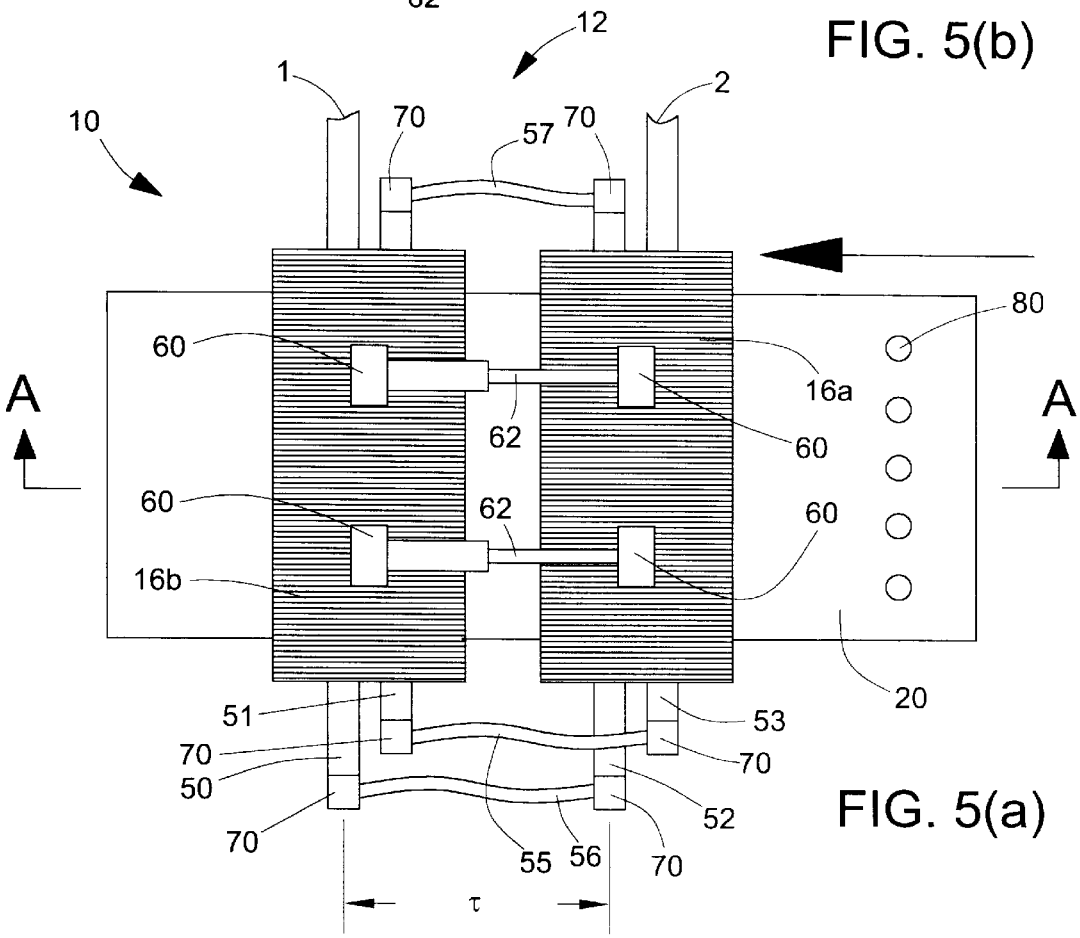

There is shown in FIG. 3, FIG. 5(*a*) and FIG. 5(*b*), a first example of the transverse flux induction heating apparatus 10 of the present invention. The apparatus 10 includes a coil pair comprising a first and second coil, 12 and 14, respectively, that is used to inductively heat a workpiece 20, such as a metal strip, passing between the first and second coils. In this particular example of the invention, a two-turn coil arrangement is used. A single-turn coil pair, more than two-turn coil pair arrangements, or multiple coil pairs can be used without deviating from the scope of the invention. Each turn of the first and second two-turn coils comprises two transverse coil segments, for example, segments 40 and 42, and segments 41 and 43, for the two coil turns making up second coil 14. All transverse coil segments are arranged substantially perpendicular to the longitudinal direction of the workpiece and are generally longer than the width (transverse) of the workpiece. The longitudinal distance between corresponding pairs of transverse coil segments that comprise a coil turn represents the pole pitch, $\tau$, for each coil turn. The pole pitch for each turn making up the first coil is substantially the same as the pole pitch for each corresponding turn making up the second coil. Further corresponding transverse segment pairs (i.e., 50 and 40; 52 and 42; 51 and 41; and 53 and 43) of first coil 12 and second coil 14 lie substantially in a plane perpendicular to the longitudinal direction of the workpiece (indicated by an arrow labeled "X" in FIG. 3) so that the created flux remains substantially perpendicular to the surface of the workpiece.

Each turn of the first and second coils has an adjustable coil segment that connects together two transverse coil segments of a turn to complete a coil turn, and connects the two coil turns that make up the first or second coil. For example, adjustable coil segments 45, 46 and 47 join transverse coil segments 40 and 42, 41 and 43, and 41 and 42, respectively, for second coil 14. Each adjustable coil segment is generally oriented in the longitudinal direction of the workpiece 20. Each adjustable coil segment may be a flexible cable or other flexible electrical conductor that is suitably connected (connecting element 70 diagrammatically shown in the figures) at each end to a transverse coil segment. Any electrically conducting material and arrangement, including multiple interconnecting sliding partial segments, may be used for each adjustable coil segment as long as it can maintain electrical continuity in a coil turn as the pole pitch is changed as further described below.

Further, in applications where the first and second coils are water-cooled by circulating cooling water through hollow passages in the first and second coil segments, the adjustable coil segments can be used as convenient connection points to the supply and return of a cooling medium, such as water.

Magnetic flux concentrators 16*a* and 16*b* (formed from high permeability, low reluctance materials such as steel laminations) generally surround transverse coil segments 52 and 53, and 50 and 51, respectively, of the first coil in all directions except for the coil surfaces facing workpiece 20. For clarity of coil arrangements in FIG. 3, the concentrators for coil 12 is shown in broken view and the concentrators for coil 14 are not shown. In this exploded view, coil gap, $g_c$, is exaggerated. In typical applications, the coil gap is generally only larger than the thickness, $d_s$, of the workpiece as to allow unobstructed travel of the workpiece between the coils. When terminals 1 and 3 are connected (either directly or indirectly by, for example, a load matching transformer) to the first output terminal of an ac single-phase power source, and terminals 2 and 4 are connected to the second output terminal of the power source, the currents flowing through the first and second coils establish a common magnetic flux that passes perpendicularly through the workpiece as illustrated by the exemplary dashed flux line in FIG. 3, with the arrows indicating the direction of the flux when the current at terminals 1 and 3 is instantaneously positive and the current at terminals 2 and 4 is instantaneously negative.

As shown in FIG. 5(*a*) and FIG. 5(*b*), mounting means 60 are provided and attached either directly or indirectly to each of the four magnetic flux concentrators, 16*a*, 16*b*, 16*c* and 16*d*, and its associated transverse coil segments, namely 52 and 53, 50 and 51, 42 and 43, and 40 and 41, respectively. Mounting means 60 provides means for attachment of a pole pitch adjusting apparatus 62 as shown in FIG. 5(*a*) and FIG. 5(*b*) (not shown in FIG. 3 for clarity). The pole pitch adjusting apparatus provides the means for changing the coil pitch, $\tau$, between transverse coil segments of each coil turn. In the present example, the pole pitch adjusting apparatus can be jack screws that are either manually or automatically operated by remote control. Further, while two jack screws are used in the present example other arrangements and configurations of pole pitch adjusting apparatus are contemplated as being within the scope of the present invention. The adjustable coil segments, 55, 56 and 57 in the first coil 12, and 45, 46 and 47 in the second coil 14, allow the jack screws to move the transverse coil segments of the first coil 12 and the second coil 14 closer to each other (smaller pole pitch) or farther away from each other (larger pole pitch) in the longitudinal direction of the workpiece. Further in the preferred example of the invention, movement of corresponding transverse segments of the first and second coils is synchronized so that the pole pitch for each turn making up the first coil remains substantially the same as the pole pitch for the corresponding turn making up the second coil.

Figure 1:
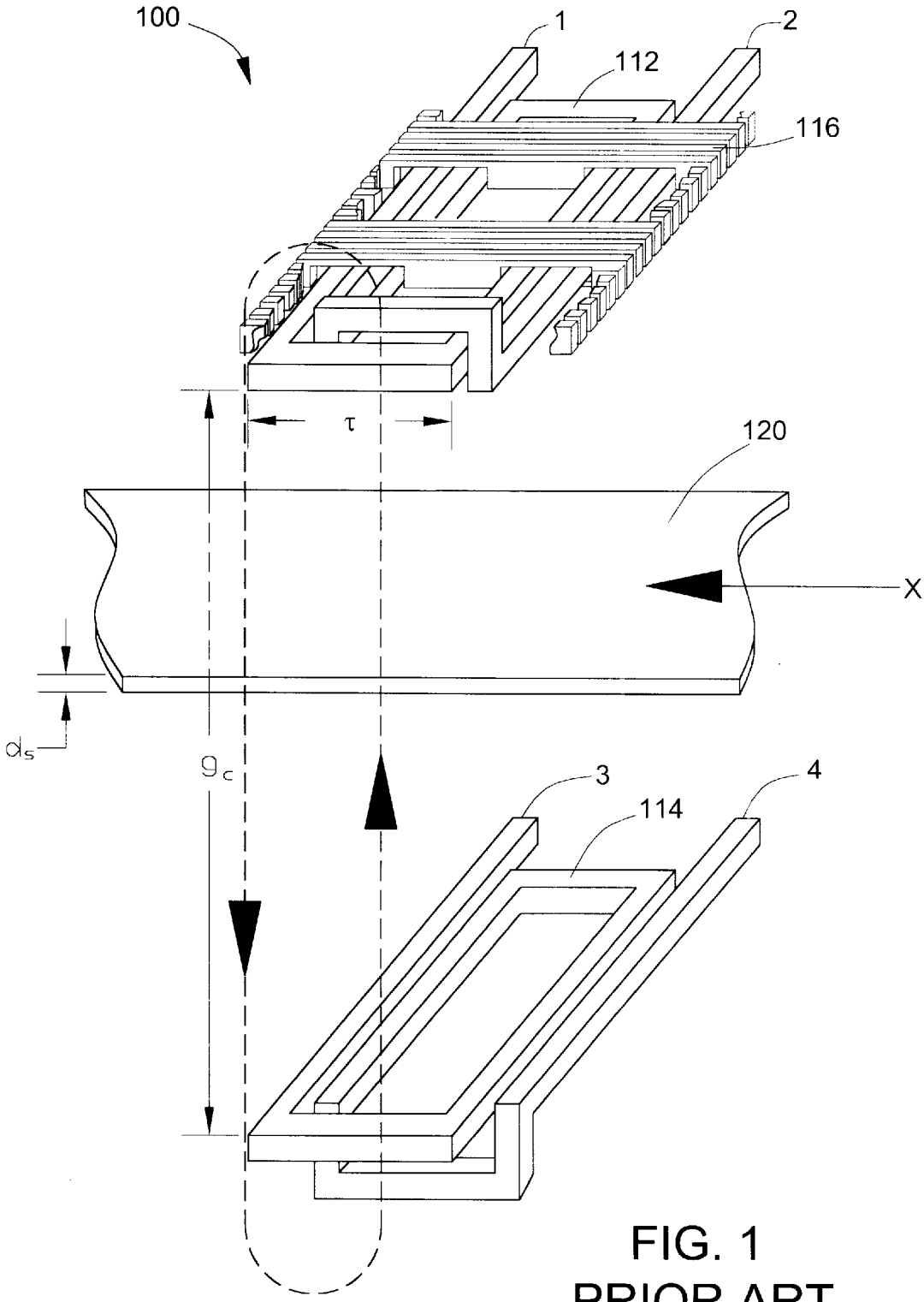
FIG. 1 PRIOR ART
FIG. 1 is an exploded perspective view of a conventional prior art transverse flux induction heating apparatus.
Figure 2:
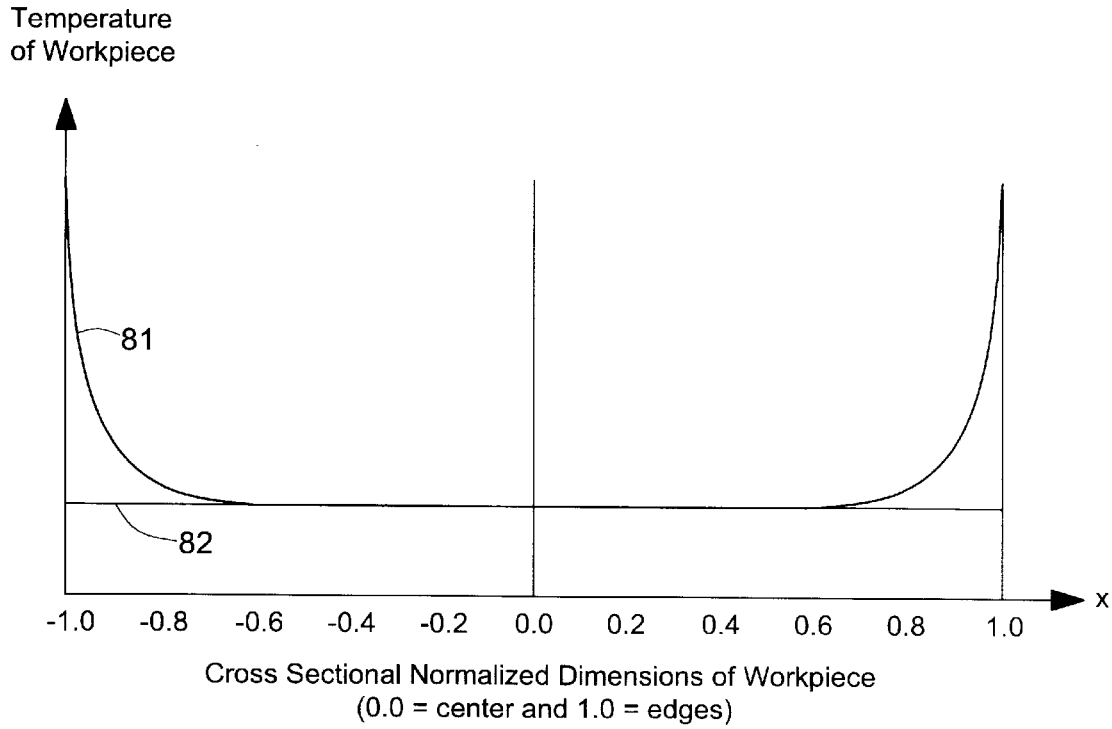
FIG. 2 is a graph of typical (non-uniform) and ideal (uniform) cross section temperature distributions of a workpiece inductively heated with a transverse flux induction heating apparatus.
Figure 4:
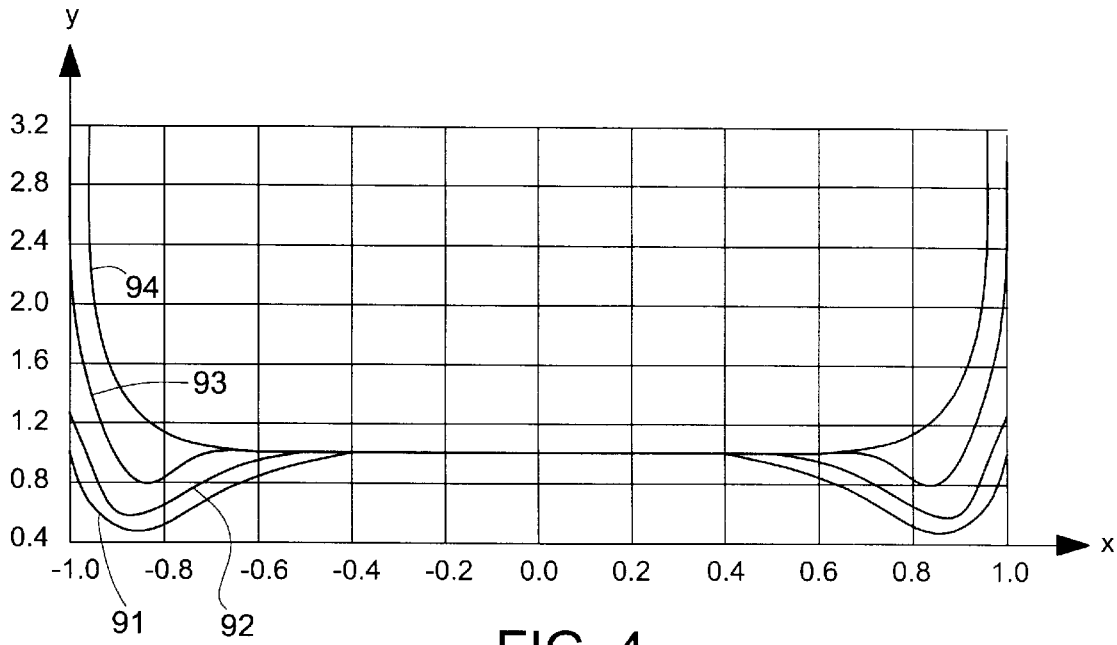
FIG. 4 is a graph of typical cross section temperature distributions of a workpiece inductively heated with one example of a transverse flux induction heating apparatus of the present invention.

FIG. 4 illustrates the general effect that a change in pole pitch has on the cross sectional heating temperature profile for the induction heating apparatus of the present invention. In FIG. 4, the x-axis represents the normalized width (transverse) of a workpiece from its center (point 0.0 on the x-axis) to its edges (points±1.0 on the x-axis). The y-axis represents the normalized transverse temperature of a workpiece having a normalized temperature of 1.0 at its center (point 0.0).

The equivalent depth of induced current penetration, $\Delta_o$, in meters, is defined by the following equation:

$$\Delta_0 = 503 \cdot \sqrt{\frac{\rho_s}{f} \cdot \frac{g_c}{d_s}}$$

where $\rho_s$=the resistivity of the workpiece (in $\Omega$·m);

f=the frequency (in Hertz) of the induction power source;

$g_c$=the distance between the first and second coils; and $d_s$=the thickness of the workpiece.

In the present invention, for a given workpiece with a substantially constant resistivity and thickness, the distance between the first and second coils, $g_c$, and the frequency of the induction power source are kept substantially constant. Curves 91, 92, 93 and 94 in FIG. 4 represent four different cross sectional heating temperature profiles for a workpiece inductively heated by the apparatus of the present invention. Curves 91 through 94 are a parametric set of curves that are defined by the relationship $$\frac{\tau}{\Delta_0} = k$$

where k=constant.

As the coil pitch, $\tau$, increases for a substantially constant $\Delta_o$, the cross sectional heating of the workpiece generally progresses from that shown in curve 91, through curves 92 and 93, and to curve 94. For example, for one particular substantially constant set of the four variables used to determine $\Delta_o$, the four curves in FIG. 4 are parametric representations where the following mathematical relationship is maintained between $\tau$ and $\Delta_o$:

| Curve | $k = \tau/\Delta_o$ |
|---|---|
| 91 | 0.5 |
| 92 | 1.0 |
| 93 | 2.0 |
| 94 | 3.0 |

Thus, with $\Delta_o$ (depth of current penetration) held substantially constant, as the coil pitch, $\tau$, increases, edge heating correspondingly increases from that shown in curve 91 to that shown in curve 94. For example, if higher edge heating of the workpiece is desired when pole pitch is currently set to achieve the cross sectional temperatures in the workpiece illustrated in curve 92, the pole pitch could be increased so that the cross sectional temperatures in the workpiece illustrated in curve 93 is achieved without changing the distance between the first and second coils and the frequency of the power source.

In the present example, a plurality of temperature sensors 80, such as pyrometers, sense the temperatures across section (transverse) of workpiece prior to its entry into induction heating apparatus 10. The values of the sensed temperatures are used as an input to a means (such as an electronic processor) for determining a pre-heat cross section temperature profile of the workpiece. Thus any non-uniform transverse temperature distribution of the workpiece will be sensed prior to the workpiece moves through the transverse flux induction coil. The processor will then determine a transverse heating profile that will inductively heat the workpiece to a more uniform transverse temperature distribution. The processor will determine an appropriate pole pitch setting to achieve the more uniform cross sectional heating temperature of the workpiece, with appropriate inductive edge heating of the workpiece in apparatus 10. Processor determination of the adjustment of the pole pitch setting can be based upon a set of data curves similar to those in FIG. 4, as modified for a specific application, that can be stored in a database accessible to the processor.

Alternatively, the pole pitch may be manually adjusted at the start of a production run to achieve a desired cross sectional heating temperature of the workpiece, with appropriate inductive edge heating of the workpiece, prior to passing the workpiece between the coil pair of the heating apparatus of the present invention. In some applications, a pole pitch range of a few inches will be sufficient to provide a suitable control range of variable edge heating.

The foregoing examples do not limit the scope of the disclosed invention. The scope of the disclosed invention is further set forth in the appended claims.

What is claimed is:

1. Apparatus for induction heating of a workpiece having a non-uniform transverse temperature distribution, the apparatus comprising:

a transverse flux induction coil having an adjustable operating coil pole pitch, the workpiece moving through the transverse flux induction coil;

a plurality of temperature sensors for sensing the non-uniform transverse temperature distribution of the workpiece prior to the workpiece moving through the transverse flux induction coil; and a processor for determining a transverse induction heating profile to heat the workpiece to a substantially uniform transverse temperature distribution, the transverse induction heating profile determined from the non-uniform transverse temperature distribution of the workpiece, the processor further comprising an output signal for adjusting the pole pitch responsive to the transverse induction heating profile, whereby the transverse flux induction coil inductively heats the workpiece moving through the transverse flux induction coil to a substantially uniform transverse temperature.

2. The apparatus of claim 1 wherein the transverse flux induction coil further comprises a pair of coils comprising a first coil and a second coil, each of the first and the second coils having a one or more coil turns, the number of the one or more coil turns for the first coil equal to the number of the one or more coil turns for the second coil, and the first and the second coils disposed on opposing sides of the workpiece, each of the coil turns comprising a two transverse coil segments and an at least one adjustable coil segment connecting the two transverse coil segments of each of the coil turn, and connecting an adjacent transverse coil segments of each of the first and second coils having more than one coil turn; all of the two transverse coil segments longitudinally aligned substantially perpendicular to all of the at least one adjustable coil segment.

3. The apparatus of claim 2 wherein each of the at least one adjustable coil segments is a flexible electrical conductor.

4. The apparatus of claim 2 wherein each of the at least one adjustable coil segments comprises a plurality of electrically interconnected slidable partial segments.

5. The apparatus of claim 2 wherein an at least one of the at least one adjustable coil segments further comprises a supply and return connection for a cooling medium to cool the transverse flux induction coil.

6. The apparatus of claim 2 further comprising a mounting means connected to each of the two transverse coil segments of each of the coil turns and a pole pitch adjusting apparatus connected to the mounting means of the two transverse coil segments for each of the coil turns, whereby adjustment of the pole pitch adjusting apparatus, responsive to the output signal, adjusts the pole pitch of each coil turn.

7. An induction heating process for heating a workpiece moving through a transverse flux induction coil having a variable operating coil pole pitch, the workpiece having a non-uniform transverse temperature distribution prior to moving through the transverse flux induction coil, the process comprising the steps:

sensing the non-uniform transverse temperature distribution to establish a temperature profile of the non-uniform transverse temperature distribution;

determining an induction heating profile of a non-uniform transverse heat energy distribution from the temperature profile, the non-uniform transverse heat energy distribution to inductively heat the workpiece to an approximately uniform transverse temperature distribution; and adjusting the variable operating coil pole pitch responsive to the induction heating profile whereby the workpiece moving through the transverse flux induction coil is heated to a substantially uniform transverse temperature distribution.

8. The method of claim 7 further comprising the step of adjusting a two transverse coil segments connected by an adjustable coil segment to form a one of a plurality of coils comprising the transverse flux induction coil to adjust the variable operating pitch of the transverse flux induction coil.

9. The process of claim 8 further comprising the step of supplying and returning a cooling medium to the adjustable coil segment to cool the transverse flux induction coil.

* * * * *